US005458925A

United States Patent [19]

Hirshburg et al.

[11] Patent Number: 5,458,925

[45] Date of Patent: Oct. 17, 1995

[54] DUAL GEOMETRY FOR SLIDE-BEAD COATING

[75] Inventors: Robert I. Hirshburg, Hendersonville, N.C.; Kostas N. Christodoulou, Wilmington, Del.

[73] Assignee: E. I. Du Pont de Nemours and Company, Wilmington, Del.

[21] Appl. No.: 266,401

[22] Filed: Jun. 27, 1994

[51] Int. Cl.[6] ..... B05D 1/34; B05C 5/02

[52] U.S. Cl. ..... 427/402; 427/420; 118/410; 118/411

[58] Field of Search ..... 427/402, 420; 118/410, 411

[56] References Cited

U.S. PATENT DOCUMENTS

| | | | |
|---|---|---|---|
| 2,761,417 | 9/1956 | Russell et al. | 118/410 |
| 2,761,419 | 9/1956 | Mercier et al. | 118/412 |
| 2,761,791 | 9/1956 | Russell | 117/34 |
| 3,993,019 | 11/1976 | Jackson | 118/50 |
| 3,996,885 | 12/1976 | Jackson et al. | 118/50 |
| 4,283,443 | 8/1981 | Choinski | 427/295 |
| 4,297,396 | 10/1981 | Takehara et al. | 427/284 |
| 4,299,188 | 11/1981 | Isayama et al. | 118/412 |
| 4,313,980 | 2/1982 | Willemsens | 427/402 |
| 4,440,811 | 4/1984 | Hitaka et al. | 427/402 |
| 4,443,504 | 4/1984 | Burket et al. | 427/445 |
| 4,525,392 | 6/1985 | Ishizaki et al. | 118/411 |
| 5,332,440 | 7/1994 | Hirshburg | 427/402 |

FOREIGN PATENT DOCUMENTS 60-28851 2/1985 Japan .

*Primary Examiner*—Shrive Beck
*Assistant Examiner*—Katherine A. Bareford
*Attorney, Agent, or Firm*—Thomas H. Magee

[57] ABSTRACT

A slide-bead coating technique utilizes a dual slide that includes an upper slide surface connected to a lower slide surface terminating at a coating lip. A substrate is transported on a coating roll past the coating lip so as to form a liquid bead at a coating location disposed between the coating lip and the substrate. The coating location is positioned more than ten degrees (10°) but no more than fifty degrees (50°) circumferentially below a horizontal centerplane passing through an axis of rotation of the coating roll. The lower slide surface forms an angle of between eighty-five degrees (85°) and ninety-five degrees (95°) with the plane tangent to the surface of the substrate at the coating location.

7 Claims, 2 Drawing Sheets

DUAL GEOMETRY FOR SLIDE-BEAD COATING

BACKGROUND OF THE INVENTION

1. Field of the Invention

The present invention pertains to a slide-bead coating apparatus and method. More specifically, this invention pertains to a particular geometry used in the slide-bead coating apparatus for application of either a single flowing material or a plurality of flowing materials onto a moving substrate.

2. Description of the Related Art

Slide-bead coating is known in the art for supplying a flowing liquid layer or plurality of liquid layers down a slide surface to an efflux end, or lip, at which a liquid bridge, or bead, is formed in a gap between the lip and a moving substrate. As shown in FIG. 2 for coaters of prior art design, the liquid flow near the end of the slide surface has a profile shape that displays a thickened region followed by a thinning region followed by the liquid bridging the gap. The surface of the liquid flow at the end of the slide surface and in the gap is thus highly curved. The moving substrate carries away liquid from the liquid inventory in the bead in the same layered structure established on the slide. Exemplary examples are described in U.S. Pat. Nos. 2,761,791 and 2,761,419 issued, respectively, to Russell and Mercier et al.

For a given coater arrangement, substrate velocity, coating liquid and flow conditions, there is an operative range of applied differential pressures within which satisfactory coatings are obtained. The range limits are defined by the onset of bead instabilities and/or other practical considerations. As the differential pressure is increased above the operative range, or while maintaining the same differential pressure as the substrate velocity is increased above the associated operative range, the surface of the coating bead becomes so highly curved that the bead becomes unstable and gives rise to evenly-spaced disturbances, or ribbing, in the subsequent coating, as described by Saito et al. in "Instability of the Slide Coating Flow", 1982 Winter National AIChE Meeting, Orlando, Fla. If the differential pressure is decreased, a condition is reached whereby the differential pressure is insufficient to maintain an even covering of coating liquid over the desired width and/or the bead becomes unstable all along its width. The catastrophic results include narrowed and uneven coatings, or a complete loss of continuous coating. The difference in the limits of the upper extreme and the lower extreme for differential pressures described above constitutes what is herein called a useful differential pressure range for producing coatings of satisfactory quality and width. Examples of methods and apparatus to increase the useful differential pressure range are described in U.S. Pat. No. 4,443,504 issued to Burket et al., U.S. Pat. No. 3,996,885 issued to Jackson et al., U.S. Pat. No. 4,440,811 issued to Hitaka et al. U.S. Pat. No. 4,297,396 issued to Takehara et al. describes methods for increasing the maximum differential pressure, and U.S. Pat. No. 4,313,980 issued to Willemsens describes a method and device for reducing the minimum useful differential pressure.

It is known in the art that maximum differential pressure decreases as coating velocity increases. Therefore, increasing the maximum differential pressure at a given velocity is of utmost concern since this provides the practitioner with two choices, both of which are desirable. The coating velocity can remain fixed, in which case the increased maximum differential pressure provides operational latitude. Disturbances are less likely to cause perturbations in the solution flow. The increased maximum differential pressure also allows the practitioner to operate at a higher coating velocity, if desired, which has the expected benefits of higher productivity.

Improvements in the art are described in U.S. Pat. No. 3,993,019 issued to Jackson, wherein the slide comprises two regions. The region closest to the substrate is less downwardly inclined than the region further from the substrate, and of sufficient length to facilitate pooling just prior to the bead region. The pooling provides some advantage, yet further improvement in coating speed and operational latitude are still highly desired. The advantage is best observed when the coating is applied near the horizontal centerline of the roll, and decreases as other coating configurations are utilized. However, with pooling, particles may more readily settle from the coating liquid, become attached to the lip and produce disturbances in the liquid flow, thus resulting in defects in the subsequent coating.

Upwardly directed flow designs are taught in U.S. Pat. Nos. 4,283,443 and 4,299,188 issued, respectively, to Choinski and Isayama et al. The upwardly directed lip region in U.S. Pat. No. 4,283,443 is required to be of sufficient length as to result in pooling. Consequently, the operational latitude advantage is limited, and it is susceptible to the deleterious settling effect. The upwardly directed lip region of U.S. Pat. No. 4,299,188 is limited in size, and results in an incrementally improved operational latitude advantage. However, a practical realization of this design will still be susceptible to pooling although to a lesser extent. Furthermore, both of these upturned lip designs provide a lip edge which is sharp and easily damaged. A damaged lip edge is deleterious to coating quality, and replacement or repair time causes lost productivity.

It is an object of the present invention to provide a slide-bead coating apparatus which increases the maximum differential pressure for onset of coating ribbing. It is another object of the present invention to provide a slide-bead coating apparatus which can be operated at a higher coating velocity. It is another object of the present invention to provide a slide-bead coating apparatus which can provide increased yields.

SUMMARY OF THE INVENTION

The present invention comprises a slide-bead coating technique which utilizes a dual slide that includes an upper slide surface connected to a lower slide surface terminating at a coating lip. A substrate is transported on a coating roll past the coating lip so as to form a liquid bead at a coating location disposed between the coating lip and the substrate. The coating location is positioned more than ten degrees (10°) but no more than fifty degrees (50°) circumferentially below a horizontal centerplane passing through an axis of rotation of the coating roll. The lower slide surface forms an angle of between eighty-five degrees (85°) and ninety-five degrees (95°) with the plane tangent to the surface of the substrate at the coating location.

DETAILED DESCRIPTION OF THE PREFERRED EMBODIMENT

Figure 1:
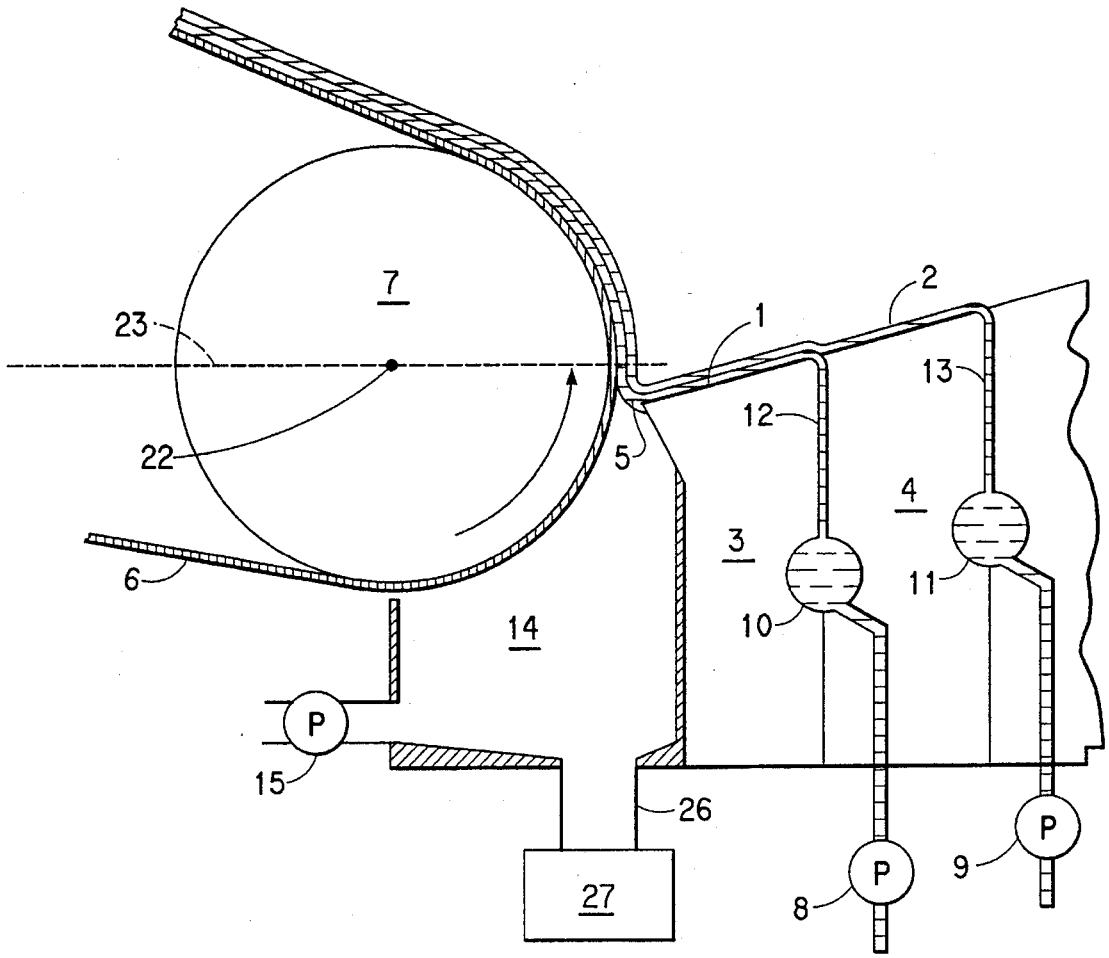
FIG. 1 (PRIOR ART)
FIG. 1 is a schematic partial elevation view of a prior art slide-bead coating apparatus.

FIG. 1 shows a conventional slide-bead coating apparatus. Liquids 1 and 2 to be coated are supplied to a slide-type hopper coating head assembly comprising coating plates 3 and 4. Coating additional layers would require additional plates, which are not illustrated. The liquids 1 and 2 flow down an inclined slide surface and traverse a gap 5 between the closest plate 3 and a substrate 6, thereby forming a coated layer on the substrate 6. The substrate 6 to be coated is conveyed by a coating roll 7 having an axis 22 of rotation and a horizontal centerplane 23 passing through the axis 22. The coating liquids 1 and 2 are supplied by supply pumps 8 and 9, which feed into cavities 10 and 11, and slots 12 and 13. An appropriate number of pumps, cavities and slots are required to coat more layers than that depicted in the embodiment shown. A chamber 14 and an associated pump 15 are adapted to reduce the gas pressure on the lower surface of the liquid in the gap 5. A drain tube 26 and sump 27 are typically provided to remove material from the chamber 14.

Figure 2:
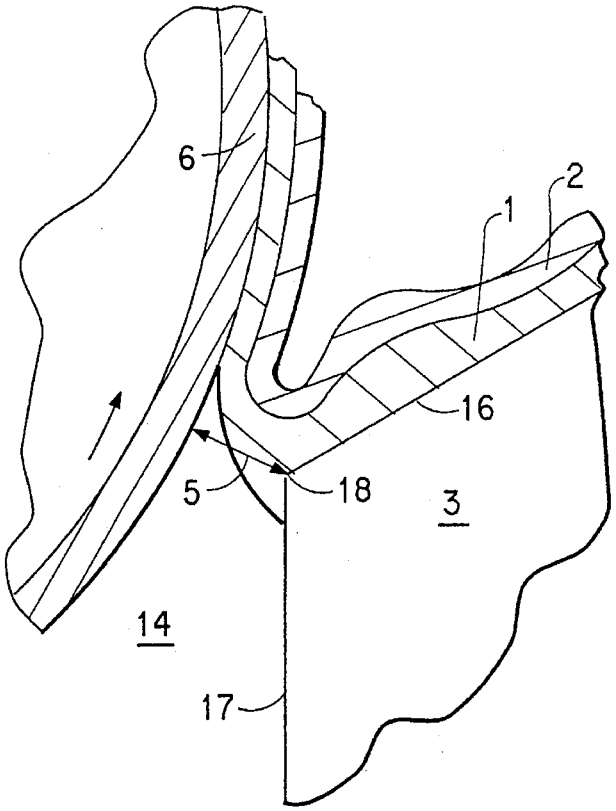
FIG.2 (PRIOR ART)
FIG. 2 is a schematic partial elevation view of the bead region shown in the prior art apparatus of FIG. 1.

FIG. 2 shows the slide-bead coating apparatus at the point where the liquids 1 and 2 flow across the gap 5 between the plate 3 and the substrate 6. The liquid in this gap 5 is typically referred to in the art as the bead. A slide surface 16 and lip land 17 meet to form a lip 18.

Figure 3:
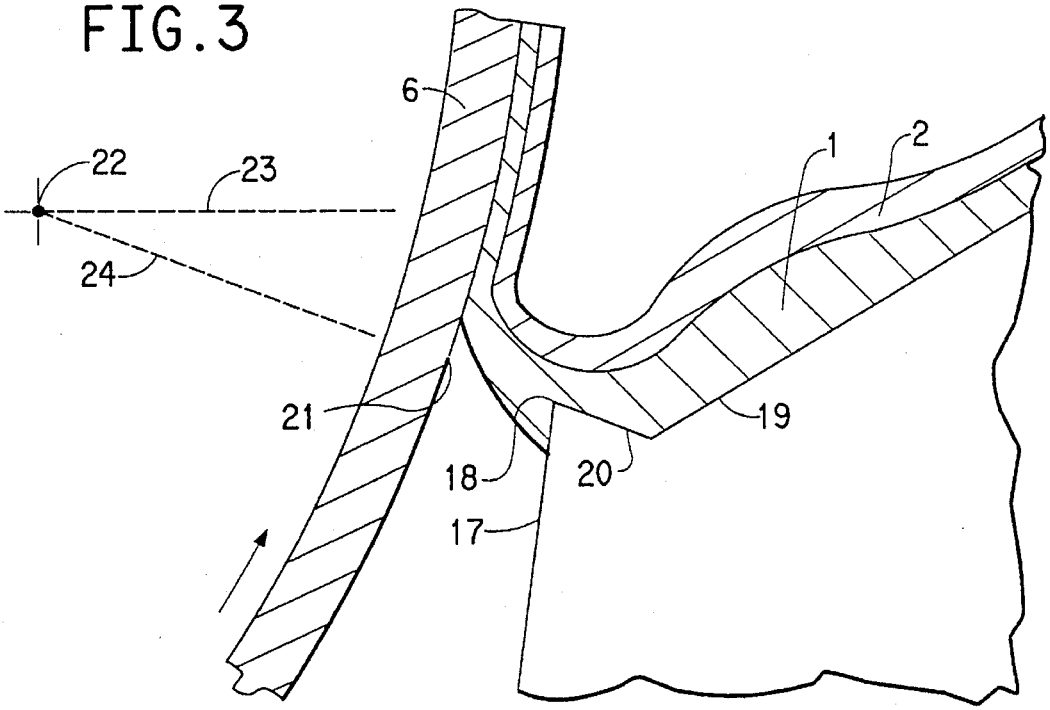
FIG. 3 is a partial cross-sectional elevation view of an embodiment of the present invention.

FIG. 3 shows a dual slide system of the present invention. In FIG. 3, the liquids 1 and 2 and substrate 6 correspond to similarly numbered elements described above. The inventive dual slide comprises an upper slide 19 and a lower slide 20, wherein the lower slide 20 intersects the lip land 17 at the lip 18. The upper slide 19 is downwardly inclined towards the substrate 6. An angle of inclination of 10°–45° relative to horizontal is preferred. The lower slide 20 is, preferably, 0.25 to 1.00 mm in length; more preferred is a lower slide of 0.25 to 0.75 mm in length, and most preferred is 0.40 to 0.60 mm in length. The upper slide 19, lower slide 20, lip 18 and lip land 17 are at least as wide as the width of the coating layer. A coating line 21 is the line on the surface of the substrate 6 which intersects a plane 24 containing both the lip 18 and the axis 22 of rotation of the coating roll 7 (not shown in FIG. 3). The definition of "coating location" is the apparent location on the substrate 6 at which the coating layer is applied. The coating location is typically near the coating line 21 and, for convenience, the coating location is defined to be the same as the coating line 21.

In the inventive apparatus, the coating location is circumferentially below the horizontal centerplane of the coating roll 7 by more than 10° but not more than 50°. More preferable is a coating location of more than 10° but no more than 20° below the horizontal centerplane of the coating roll 7.

The face of the lower slide 20 is preferably perpendicular to the plane tangent to the substrate 6 at the coating location. In practice, the angle between the face of the lower slide 20 and the plane tangent to the surface of the substrate 6 at the coating location is preferably between 85° and 95°; more preferred is between 89° and 91°. For convenience, 85° is defined such that it corresponds to 5° below perpendicular, and 95° is defined such that it corresponds to 5° above perpendicular (to the tangent plane). As fabricated in practice, the juncture between the upper and lower slide surfaces 19 and 20 will be approximated by an internal cylindrical section. To achieve the greatest benefit in extending operating vacuum range, the radius of curvature of this section should be kept small but not so small as to form a sharp corner that will produce a stagnant or recirculating zone in the flow. In practice, a radius of curvature of 0.075 mm is suitable. Beneficial effect is achieved, albeit less advantageously, as the extent of the curved section is increased to the point where the lower slide 20 is completely curved. In this case, the plane tangent to the terminus of the curved lower slide 20 will preferably be between 85° and 95° to the plane tangent to the surface of the substrate 6 at the coating location.

With a coating location that is more than 10° below the horizontal plane, an angle between the lower slide and the plane tangent to the substrate of 85°–95° provides the advantage of increasing maximum differential pressure. With this arrangement, the thinning region of the liquid flow is redirected, as shown in FIG. 3, such that the surface of the bead is much less curved than that shown with the coater of the prior art design in FIG. 2. Consequently, the differential pressure required to manipulate the bead into an unstable configuration at a given coating speed is greatly increased. Redirecting the lower slide at angles less than 85° creates a lip region that is sharp and easily damaged, although some benefit in operational latitude is achieved. This increase in maximum differential pressure obtained with the present invention is more significant when the lower slide is relatively short such that the cumulative influence of gravity is small and pooling is minimized. The effect is most notably demonstrated where the lower slide is 0.5 mm in length.

The invention described herein is useful for a myriad of flowing liquid layers including, but not limited to, those with photosensitive and/or radiation sensitive liquids. These photosensitive and/or radiation sensitive layers may be used for imaging and reproduction in fields such as graphic arts, printing, medical and information systems. Silver halide photosensitive layers and their associated layers are preferred. Photopolymer, diazo, vesicular image-forming compositions and other systems may be used in addition to silver halide.

The supporting substrate for the layers used in the novel process may be any suitable transparent plastic or paper. Examples of suitable plastic films include, but are not limited to, cellulosic supports, e.g., cellulose acetate, cellulose triacetate, cellulose mixed esters, polyethylene terephthalate/isophthalates and the like. The above-mentioned polyester films are particularly suitable because of their dimensional stability. During the manufacture of such films it is preferable to apply a resin subbing layer such as, for example, the mixed-polymer subbing compositions of vinylidene chlorideitaconic acid, as taught by Rawlins in U.S. Pat. No. 3,567,452, or the antistatic compositions taught by Miller in U.S. Pat. Nos. 4,916,011 and 4,701,403, and Cho in U.S. Pat. No. 4,891,308.

The term 'flowing liquid layers' is intended to refer to a single layer or to a multiplicity of simultaneously coated layers, as known in the art. The application of multiple layers requires multiple coating hoppers.

The coated layer of a photographic film is dried by liquid medium evaporation. The evaporation is preferably accelerated by conduction, convection and/or radiation heating. Heat transfer can occur through the supporting substrate, such as by physical contact with a heated drum or roller, or by direct contact with a gaseous medium such as warm air, as illustrated by Van Derhoef et al. in U.S. Pat. No. 2,269,169, Rose in U.S. Pat. No. 2,620,285, Ruff in German OLS No. 2,703,776 and Arter et al. in U.S. Pat. No. 4,365,423. Jet impingement of the coated layers with a gaseous medium provides both a heat and mass transfer medium, as illustrated by Willis in U.S. Pat. No. 1,951,004, Allander et al. in U.S. Pat. No. 3,012,335, Meier-Windhorst in U.S. Pat. No. 3,041,739, Stelling in U.S. Pat. No. 3,074,179, Darcy et al. in U.S. Pat. No. 3,599,341 and Stibbe in U.S. Pat. No. 4,116,620. Radiation to which the photographic film is relatively insensitive can be used to facilitate liquid medium evaporation as illustrated by Beck in U.S. Pat. Nos. 2,815,307 and 3,898,882. Also applicable is microwave heating, as illustrated by Dippel et al. in U.S. Pat. No. 3,588,218, Cunningham et al. in U.S. Pat. No. 2,662,302, Bleackley in U.S. Pat. No. 3,466,415, Hering in U.S. Pat. No. 3,589,022, Stephansen in U.S. Pat. No. 3,672,066, Philips in U.K. Patent No. 633,731 and Kuroki et al. in U.K. Patent No. 1,207,222.

These teachings are best displayed by the following examples which are not intended to limit the scope of the invention described herein.

EXAMPLE 1—CONTROL

Two distinct layers were coated on a polyethylene terephthalate substrate with a slide-bead coater operating at 150 meters/minute. The upper layer was a 7% gelatin-water solution (viscosity of 13 cp), coated at a wet thickness of 20 micrometers. The lower layer was a 6% gelatin solution with 9% AgBr in colloidal suspension (viscosity of 8.9 cp), coated at a wet thickness of 50 micrometers. The slide coater comprised a single flat slide surface inclined approximately 23° from horizontal and positioned such that the coating lip and substrate surface are separated by a coating gap of 0.25 mm at approximately 15° below the horizontal centerline of the roll. With this slide coating device at these coating conditions, the differential pressure applied to the coater vacuum chamber was increased until evenly-spaced disturbances were observed across the substrate. The differential pressure was then slowly decreased, and the differential pressure at which the evenly-spaced disturbances disappeared was defined as the maximum differential pressure. For this control, the maximum differential pressure was observed to be 82 Pa (0.33 inches $H_2O$).

EXAMPLE 2—INVENTIVE

All conditions from Example 1 were duplicated except that the slide surface had a 0.5 mm lower slide which was inclined with respect to the upper slide such that the angle between the face of the lower slide and the plane tangent to the surface of the substrate at the coating location was 90°. This orientation corresponds to approximately a 15° angle between the lower slide and the horizontal. With this inventive slide coating device, the observed maximum differential pressure was 370 Pa (1.50 inches of $H_2O$).

EXAMPLE 3—COMPARATIVE

All conditions from Example 1 were duplicated except that the slide surface had a lower slide 0.55 mm long which was inclined with respect to the upper slide such that the angle between the face of the lower slide and the plane tangent to the surface of the substrate at the coating location was 110°, which corresponds to a 5° inclination with respect to horizontal. The lower slide angle of this configuration is within the teaching of U.S. Pat. No. 3,993,019 issued to Jackson. With this slide coating device at these conditions, the maximum differential pressure was observed to be 170 Pa (0.67 inches of $H_2O$).

EXAMPLE 4—INVENTIVE

All conditions from Example 1 were duplicated except that the slide surface had a lower slide which was 1.0 mm in length, and the lower slide was inclined with respect to the upper slide such that the angle between the face of the lower slide and the plane tangent to the surface of the substrate was 90° at the coating location, which corresponds to a lower slide surface inclination of approximately 15° with respect to horizontal. With this slide coating device, the maximum differential pressure was observed to be 210 Pa (0.85 inches of $H_2O$).

What is claimed is:

1. In a method for coating a substrate including the steps of initiating a flow of liquid from a liquid layer supply means to form at least one flowing liquid layer on a dual slide that includes an upper slide surface connected to a lower slide surface terminating at a coating lip, transporting said substrate on a coating roll rotating on an axis past said coating lip so as to form a liquid bridge or bead at a coating location disposed between said coating lip and said substrate thereby depleting liquid from said liquid bead onto said substrate, said liquid in said bead being continuously replenished from said liquid layer supply means, and positioning said coating location more than ten degrees but no more than fifty degrees circumferentially below a horizontal centerplane passing through said axis of rotation, the improvement in said method comprising the step of orienting said lower slide surface so as to form an angle of between eighty-five degrees and ninety-five degrees with the plane tangent to the surface of said substrate at said coating location, wherein said lower slide surface is 0.25 to 1.00 mm in length.

2. The method of claim 1 wherein said coating location is positioned more than ten degrees and no more than twenty degrees below said horizontal centerplane.

3. In a slide-bead coating apparatus having a dual slide that includes an upper slide surface connected to a lower slide surface terminating at a coating lip, a coating roll having an axis of rotation and a horizontal centerplane passing through said axis, and means for supplying at least one flowing liquid layer to said upper and said lower slide surfaces so as to form a liquid bridge or bead at a coating location disposed between said coating lip and a substrate being conveyed past said lip by said coating roll, said coating location being more than ten degrees but no more than fifty degrees circumferentially below the horizontal centerplane of said coating roll, the improvement comprising said lower slide surface forming an angle of between eighty-five degrees and ninety-five degrees with the plane tangent to the surface of said substrate at said coating location wherein said lower slide surface is 0.25 to 1.00 mm in length.

4. The apparatus of claim 3 wherein said lower slide surface is 0.25 to 0.75 mm in length.

5. The apparatus of claim 3 wherein said lower slide surface is 0.40 to 0.60 mm in length.

6. The apparatus of claim 3 wherein said lower slide surface forms an angle of 89°–91° with the plane tangent to the surface of said substrate at said coating location.

7. The apparatus of claim 3 wherein said coating location is more than 10° and no more than 20° below said horizontal centerplane.

* * * * *